United States Patent [19]

Desrosiers

[11] Patent Number: 4,779,426

[45] Date of Patent: Oct. 25, 1988

[54] WATER COOLER WITH ONE-PIECE REMOVABLE WELL

[75] Inventor: André Desrosiers, Montreal, Canada

[73] Assignee: Les Produits Addico Inc., Montreal, Canada

[21] Appl. No.: 136,341

[22] Filed: Dec. 22, 1987

[51] Int. Cl.[4] ..... B67D 5/62

[52] U.S. Cl. ..... 62/390; 62/395; 222/146.6

[58] Field of Search ..... 222/146.6; 62/395, 393, 62/390, 391, 394

[56] References Cited

U.S. PATENT DOCUMENTS

| | | | |
|---|---|---|---|
| 1,985,064 | 12/1934 | Steenstrup | 62/395 |
| 2,775,877 | 1/1957 | Bruntjen | 62/395 X |
| 4,293,082 | 10/1981 | Matsueda | 222/146.6 X |
| 4,597,509 | 7/1986 | Peveira | 62/394 |
| 4,629,096 | 12/1986 | Schvoer et al. | 62/395 X |

*Primary Examiner*—Lloyd L. King

[57] ABSTRACT

A water cooler comprising a support base having a top wall with a top opening therein. A refrigerating coil is located inside the base and supported a predetermined distance from the top opening. A one-piece removable well having a liquid retaining reservoir and a support flange wall, is removable supported on the top wall of the support base with the support flange in support contact on the top wall and the reservoir extending through the top opening with a lower portion of the reservoir disposed internally of the refrigerating coil and in close fit therewith. The reservoir has an upper portion with separating means being provided for separating the lower and upper portions and permitting liquid flow therebetween. The support flange is provided with a support wall disposed about the reservoir for supporting a liquid container having a bottle neck. The container is supported in an inverted position with the bottle neck extending into the upper portion of the reservoir above the separating means. The container support wall permits air flow between the reservoir upper portion and atmosphere and about the container.

11 Claims, 1 Drawing Sheet

WATER COOLER WITH ONE-PIECE REMOVABLE WELL

BACKGROUND OF THE INVENTION

Field of the invention

The present invention relates to an improved water cooler for dispensing water provided in bottle containers and wherein the bottle container is concealed inside an upper part of the water cooler and wherein the well of the cooler is molded as a single piece and easily removed for cleaning and servicing.

Description of Prior Art

Various type of water coolers are known, but these mostly consist in an open top end base in which a water bottle is placed in an inverted position with the neck of the bottle extending into a well of the base. A disadvantage of such water coolers is that, they are not of an aesthetically pleasing design, they are not totally hygienic due to the fact that the well is continuously exposed to environmental dust. Furthermore, known water coolers are very difficult to service and repair and to maintain clean. Known coolers also only supply refrigerated water and do not provide access to the water directly in the bottle which is at room temperature.

SUMMARY OF INVENTION

A feature of the present invention is to provide an improved water cooler construction which substantially overcomes all of the above mentioned disadvantages of the known prior art and provides additional advantages.

According to the above feature, from a broad aspect, the present invention provides a water cooler comprising a support base having a top wall with a top opening therein. A refrigerating coil is disposed inside the base and supported a predetermined distance from the top opening. A one-piece removable well, having a liquid retaining reservoir and a support flange wall, is removably supported on the top wall with the support flange in support contact on the top wall and the reservoir extending in to the top opening with a lower portion the reservoir disposed internally of the refrigerating coil and in close fit therewith. The reservoir has an upper portion with separation means separating the lower and upper portion to define a lower and upper chamber and permitting liquid flow therebetween. The support flange has support means about the reservoir for supporting a liquid container, having a bottle neck, in an inverted position with the bottle neck extending into the upper chamber of the reservoir above the separating means. The support means permits air flow between the reservoir upper chamber and atmosphere and about the container.

A preferred embodiment of the present invention will now be described with reference to the example thereof as illustrated in the accompanying drawings, in which

DESCRIPTION OF PREFERRED EMBODIMENT

Figure 1:
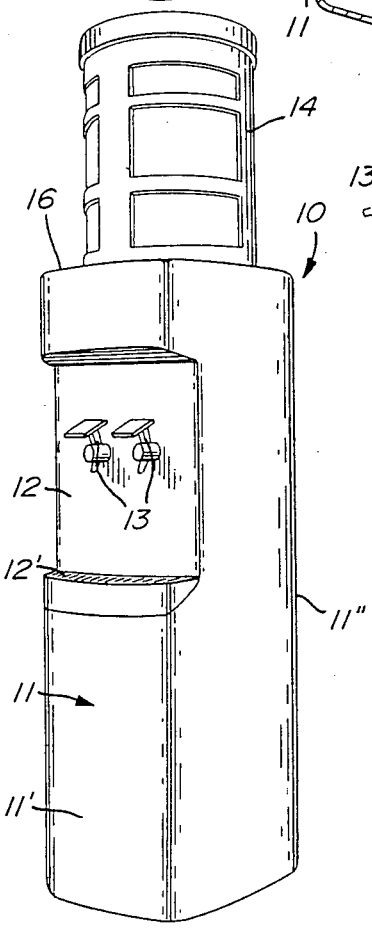
FIG. 1 is an exploded perspective view of the water cooler of the present invention.

Referring now to the drawings, and more particularly to FIG. 1, there is shown generally at 10 the water cooler of the present invention and comprising an elongated vertical support base 11 having a dispensing portion 12 which is recessed within the side wall 11' of the housing. A pair of dispensing valves 13 are provided in an upper end of the recess portion 12 for dispensing a liquid, herein water contained in a lower and upper chamber of a reservoir, respectively, and fed by a liquid container 14. A removable drip tray 12' is disposed in the lower part of the recesses dispensing portion 12. The container 14 is a water bottle having a bottle neck 15 (see FIG. 2) which is inverted into a well provided in the top wall 16 of the support base 11, as will be described later. A cover 17 is removably positionable over the top wall 16 to conceal the liquid container 14 when positioned on the top wall 16.

Figure 2:
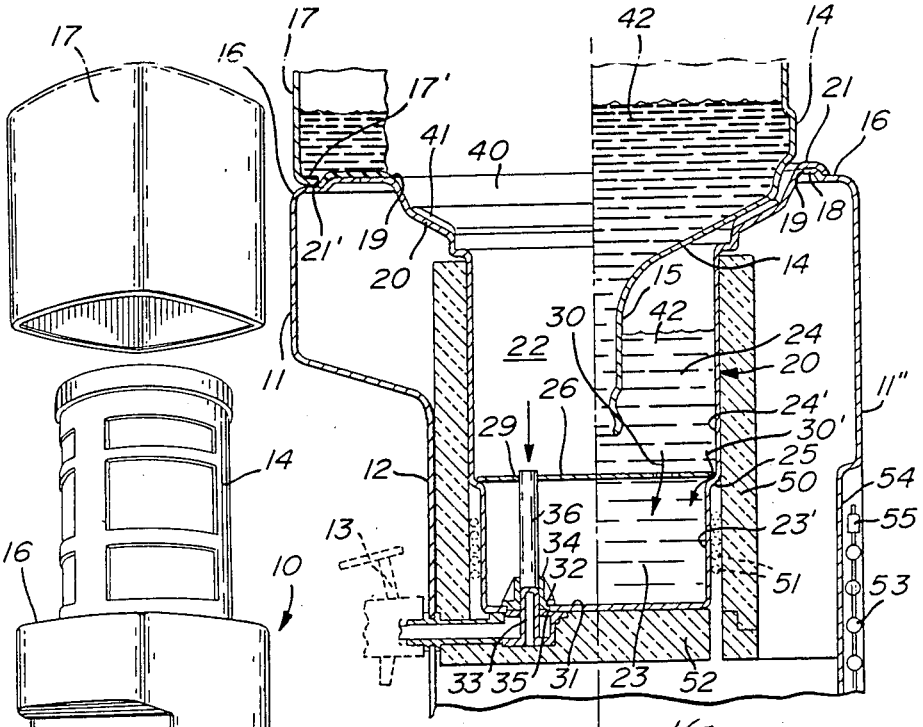
FIG. 2 is a fragmented section view showing the top end of the support base including the removable well.
Figure 3:
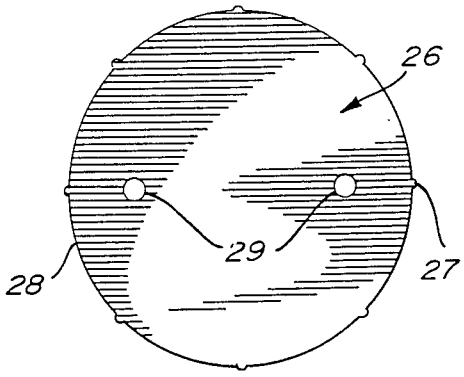
FIG. 3 is a plan view of the separator disc.

Referring now additionally to FIGS. 2 and 3, there in shown the construction of the top wall 16 of the support base 11 and a one-piece removable well 20. The top wall 16 of the support base 11 is provided with a top opening 19 having a flange wall 18 onto which a circumferential flange portion 21 of the removable well 20 is fitted. As herein shown the well 20 is molded from plastic material as a single piece.

The removable well 20 defines a liquid retaining reservoir 22 which has a lower portion 23 defining a lower chamber of slightly smaller cross-section than the upper portion 24. A circumferential support flange wall 25 is defined intermediate the lower and top portions 23 and 24 and on which is positioned, a removable wall ordisc 26 which acts as a separator wall.

As shown in FIG. 3, the disc 26 is of circular configuration and has an outer diameter which is smaller than the diameter of the reservoir upper portion 24. A plurality of spacer ribs 27 are formed about the disc for supporting the disc with the outer diameter edge 28 spaced from the inner side wall 24' of the upper chamber 24 to permit liquid flow from the upper chamber to the lower chamber about the disc as shown by arrow 30'. A large hole 29 is also provided in the disc for permitting water flow from the top chamber 24 to the lower chamber 23 in the direction of arrow 30.

The reservoir lower chamber 23 has a bottom wall 31 provided with two holes 32 (only one shown herein) into which extends the receiving ends of two conduits, only one conduit 33 shown herein. Each conduit 33 is associated with a respective one of the liquid dispensing taps 13. As herein shown, the conduit 33 is sealingly connected through the hole 32 by a sealing nut 34 to compress the lower wall 31 against a seal 35 provided about the hole 32 under the wall 31. A flexible conduit 36 extends through the lower chamber 23 and into the top chamber 24 through the hole 29 provided in the disc 26. Accordingly, the upper chamber 24 is in communication with the conduit 33. The other conduit not shown is in communication with the lower chamber 23 and is sealingly connected thereto by another nut 34 (not shown). Accordingly, each of the taps 13 dispense water from the upper and lower chamber 22 and 23, respectively. The water in the lower chamber is maintain cooler by cooling coils 51.

The upper portion of the removable well 20 defines an inwardly incline angular flange wall 40 to constitute a support means for the water bottle 14 placed in an inverted position thereon. Spacers in the form of radiating ribs 41 are spaced apart on the inclined angular flange wall 40 whereby to space the shoulder wall 41' of the bottle from the surface 40 to permit air flow between the flange wall 40 and the bottle and inside the upper chamber 24 whereby to prevent a vacuum from forming therein and preventing the gravity discharge of the liquid 42 contained within the bottle 14. As herein shown, the ribs 41 are disposed about the angular flange wall and aligned with diametrical axes of the reservoir.

The support circumferential flange wall 21 is provided with a reinforcing rib 21' which fits on the top wall 16 of the support base 11. The circumferential flange wall portion 21 is also configured to the cross-section configuration of the support base, but smaller in size, and frictionally engages the bottom contour edge 17' of the cover 17. As shown in FIG. 2, a thermo insulating open top end cylinder 50 formed of insulating foam, is supported in the support base by suitable means (not shown) below the top opening 19 in the top wall 16. The refrigerating coil 51 is disposed inside the cylinder 50 adjacent the bottom insulating wall 52 whereby to be in close fit with the bottom portion 23 of the removable well 20 when positioned in the opening 19 and refrigerates the water in the lower chamber 23. This refrigerating coil connects to refrigerating equipment (not shown) house within the lower portion of the support base 11. A heat exchange grid 53 is secured adjacent a rear opening 54 provided in the back wall 11'' of the support base 11 and hinges outwardly on hinge brackets 55 for access to the inside of the support base, when required for servicing.

As can be seen, the entire water cooler is easy to assemble and disassemble when required for servicing. The one-piece removable well 20 is detached entirely from the support base 11 by the removal of two lock nuts 34 provided inside the reservoir under the removable disc 26. The base and cover are constructed of plastic material and blow molded.

It is within the ambit of the present invention to cover any obvious modifications of the examples of the preferred embodiment described herein, provided such modifications fall within the scope of the appended claims.

I claim:

1. A water cooler comprising a support base having a top wall with a top opening therein, a refrigerating coil inside said base and supported a predetermined distance from said top opening, a one-piece removable well having a liquid retaining reservoir and a support flange wall, said removable well being removably supported on said top wall with said support flange in support contact on said top wall and said reservoir extending into said top opening with a lower portion of said reservoir disposed internally of said refrigerating coil in close fit therewith, said reservoir having an upper portion, separation means for separating said lower and upper portions to define a lower and upper chamber and permitting liquid flow therebetween, said support flange having support means about said reservoir for supporting a liquid container having a bottle neck in an inverted position with said bottle neck extending into said upper chamber of said reservoir spaced above said separation means, said support means permitting air flow between said reservoir upper and outside air and about said container, and dispensing means connected to said removable well for dispensing liquid therefrom.

2. A water cooler as claimed in claim 1, wherein there is further provided a cover removably positionable over said top wall about said support flange for concealing said liquid container when on said support flange.

3. A water cooler as claimed in claim 1, wherein said separation means is a removable disc wall supported inside said reservoir by circumferential support means, a passage in said wall for the passage of a conduit for communicating a dispensing valve with the inner area of said reservoir upper chamber above said disc wall, and one or more orifices for permitting said liquid flow from said reservoir upper chamber to said lower chamber.

4. A water cooler as claimed in claim 3, wherein said reservoir is molded with a circumferential flange wall intermediate said upper and lower portion, said disc being supported by said flange wall.

5. A water cooler as claimed in claim 3, wherein said disc is a circular disc, said reservoir being a cylindrical reservoir, said disc having an outer diameter smaller than the diameter of said reservoir upper portion, and a plurality of spacer ribs formed about said disc for supporting said disc with said outer diameter edge spaced from a side wall of said upper chamber to permit liquid flow from said upper chamber to said lower chamber about said disc.

6. A water cooler as claimed in claim 1, wherein said reservoir is a cylindrical reservoir, said support means of said support flange being constituted by an inwardly inclined annular flange wall disposed about an open top end of said reservoir and molded therewith, and spacer means on an upper surface of said annular flange wall for supporting portions of said liquid container spaced from said inwardly inclined annular flange wall.

7. A water cooler as claimed in claim 6, wherein said spacer means are ribs disposed about said annular flange wall and aligned with diametrical axes of said reservoir.

8. A water cooler as claimed in claim 2, wherein said support flange wall is provided with a circumferential reinforcing rib which sits on said top wall of said support base, said support flange wall being configured to the cross-section of said support base and frictionally engaging a bottom contour edge of said cover which is of the same cross-section as said support base.

9. A water cooler as claimed in claim 3, wherein said support base is an elongated vertical housing provided with a liquid dispensing portion recessed in a side wall thereof, a pair of dispensing valves in said dispensing portion, a drip tray spaced below said valves and disposed in said housing, each valve having a conduit communicating with a respective one of said upper and lower chambers of said reservoir.

10. A water cooler as claimed in claim 9, wherein a thermal insulating open top end cylinder is supported in said support base below said top opening in said top wall, said refrigerating coil being disposed inside said cylinder adjacent a bottom wall thereof.

11. A water cooler as claimed in claim 1 wherein said dispensing means comprises two valves each having conduit means detachably connected to said removable wall, each conduig having an intake orifice associated with a respective one of said lower and upper chamber of said well, said liquid in said lower chamber being cooler than said liquid in said upper chamber.

* * * * *